US005469196A

United States Patent [19]

Okazaki et al.

[11] Patent Number: 5,469,196

[45] Date of Patent: Nov. 21, 1995

[54] PRINT MATERIAL VARIABLE SUPPORT MECHANISM

[75] Inventors: Sandra Y. Okazaki, Vancouver, Wash.; John P. Harmon, Corvallis, Oreg.

[73] Assignee: Hewlett-Packard Company, Palo Alto, Calif.

[21] Appl. No.: 85,864

[22] Filed: Jun. 30, 1993

[51] Int. Cl.[6] ..... B41J 25/308

[52] U.S. Cl. ..... 347/8; 347/16; 347/19; 400/55

[58] Field of Search ..... 347/8, 16, 104, 347/14, 19; 400/55, 58

[56] References Cited

U.S. PATENT DOCUMENTS

| | | | |
|---|---|---|---|
| 3,673,960 | 7/1972 | Ricci et al. | 101/269 |
| 3,712,211 | 1/1973 | Thut | 101/93.36 |
| 3,768,620 | 10/1973 | Wang | 400/175 |
| 3,774,783 | 11/1973 | Miller et al. | 414/798.5 |
| 3,915,281 | 10/1975 | Blomquist et al. | 400/58 X |
| 3,995,730 | 12/1976 | Kwan et al. | 400/569 |
| 4,728,963 | 3/1988 | Rasmussen et al. | 400/649 |
| 4,920,878 | 5/1990 | Harpold et al. | 346/104 X |
| 5,356,229 | 10/1994 | Hickman et al. | 347/8 X |

FOREIGN PATENT DOCUMENTS

| | | | |
|---|---|---|---|
| 3-218849 | 9/1991 | Japan | 347/8 |
| 4-214353 | 8/1992 | Japan . | |
| 4-323067 | 11/1992 | Japan | 400/55 |

*Primary Examiner*—Benjamin R. Fuller
*Assistant Examiner*—John E. Barlow, Jr.

[57] ABSTRACT

A print material variable support mechanism to reduce buckling of print material toward a printhead during printing. The preferred embodiment includes a moveable platen pivotally mounted adjacent a drive roller. The platen is positioned adjacent and below a printhead such that the printhead and the platen define a print zone therebetween. A measuring device is operatively associated with a print controller such that the print controller effects movement of the platen during relatively high ink density printing such that the sheet is allowed to buckle downwardly. In the preferred embodiment, the measuring device is an ink drop counter which determines how many ink drops are placed on the sheet to create the desired image.

9 Claims, 3 Drawing Sheets

PRINT MATERIAL VARIABLE SUPPORT MECHANISM

TECHNICAL FIELD

The present invention relates generally to print material support mechanisms for ink-jet printers. More particularly, the invention concerns an apparatus which provides a moveable platen to reduce buckling of print medium toward a printhead during printing. When ink density on the print material reaches a predetermined threshold level, a drive mechanism moves the platen downwardly, away from the print material, so that the print material is allowed to buckle downwardly thereby avoiding contact with a printhead.

BACKGROUND ART

Conventionally, ink-jet printers include a printhead positioned above a print medium during printing. The print medium can also be referred to as print material. For purposes of this disclosure, the print material can be mylar, paper, cardboard, envelope material, or any other sheet material. A support structure, usually a platen, is positioned below and typically supports the print medium during printing. During printing, ink from the printhead is printed on the print material to form the desired image. However, ink from the printhead wets the fibers of the print material, causing the print material to buckle or curve. As the ink density, or amount of ink, printed on a page increases, the amount of bending or curving increases. Because the platen is positioned directly below the print material, the print material tends to buckle or curve upwardly instead of downwardly away from the printhead. This upward buckling increases the possibility of the print material contacting the printhead, smearing the freshly printed ink on the print material.

This buckling, or deformation, creates many additional problems. For example, the deformation creates an unappealing appearance of the final documents. In addition, as the paper deforms, the distance between the paper and the ink-jet pens, also called head-to-print material spacing, across the width of the page varies. Due to this uneven spacing during printing, the ink droplets are not evenly applied to the print material from the same distance. To achieve high quality print images, the head-to-print material spacing in an ink-jet printer should be maintained at approximately 1-to-1.5 millimeters or lower. This is relatively easy at lower ink densities, but difficult to maintain at higher densities. Thus, the uneven spacing due to print medium bending causes severe problems in the final print quality of the sheet.

In the past, in an effort to reduce these types of paper bending, printers have included high-powered heaters to drive off moisture. However, incorporating a high-powered heater into a printer adds to the complexity and to the cost of the printer mechanism. The heater also creates a fire and burn safety problem. Additionally, incorporation of a heater in a printer decreases throughput because extra time is required to drive moisture from the print material. Incorporation of heaters also causes print image distortion problems because the print medium unevenly shrinks during drying.

Other printers have included manually adjustable printheads so that the printhead is moved upwardly to compensate for an upward bend of the print material. Manual adjustment requires operator labor and therefore decreases efficiency. The additional operator labor also reduces print quality due to the possibility of operator error such as adjusting the pen in too low a position which would allow the curved paper to impact the pen.

Therefore, there is a need for a wet ink printer mechanism which reduces upward buckling of the print medium by providing a platen which moves downwardly away from the print medium during printing of relatively high ink density to ensure a relatively controlled head-to-print material spacing.

There are several variable support mechanisms which are moveable away from the print material. Kwan, U.S. Pat. No. 3,995,730, describes a moveable platen which is retractable so that an operator can insert a noncontinuous form, such as punch cards or multiple section forms. Rasmussen, U.S. Pat. No. 4,728,963, describes a moveable platen in an ink-jet printer setting. The Rasmussen platen supports the paper throughout the printing process. At the end of the process, the platen pivots downwardly, thereby eliminating undesirable clamping of the sheet of print material between the platen and a paper guide. Once the Rasmussen platen is moved away from the paper guide, the sheet is free to drop into a paper output tray. These two patents both describe a moveable print material support. However, neither describes a moveable platen which retracts during printing in response to measured ink density on the print material.

DISCLOSURE OF THE INVENTION

The invented print material variable support mechanism represents a solution to the problem of upward buckling or curving of print material during printing. The preferred embodiment includes a moveable platen pivotally attached to a drive roller by a clutch mechanism and a measuring device operatively associated with the moveable platen. In operation, the measuring device measures ink density on a print medium such that when a threshold level of ink density is reached, the clutch mechanism effects downward movement of the platen away from the print material such that the platen moves from the first, or nominal position, to a predetermined second position. With the platen in a retracted, or second position, the sheet of print material is supported by the drive roller and by the wings of an output tray, but the region of the print material located under the printhead is typically not supported by the platen. Thus, the print material in the region under the printhead is allowed to buckle or curve downwardly, thereby avoiding contact with the printhead. After printing upon the sheet is completed, the platen is moved upwardly to the original engaged, or first position such that the platen will support the next sheet of print material conveyed under the printhead. The platen will remain in its first, upward position supporting the print material, until the measuring device senses the threshold level of ink density wherein the process is repeated. Typically the platen is returned to the original, or first, position by a spring mechanism. A drive mechanism may also be utilized to effect movement of the platen to its original position.

These and additional objects and advantages of the present invention will be more readily understood after a consideration of the drawings and the detailed description of the preferred embodiment.

DETAILED DESCRIPTION OF THE PREFERRED EMBODIMENT AND BEST MODE OF CARRYING OUT THE INVENTION

Figure 4:
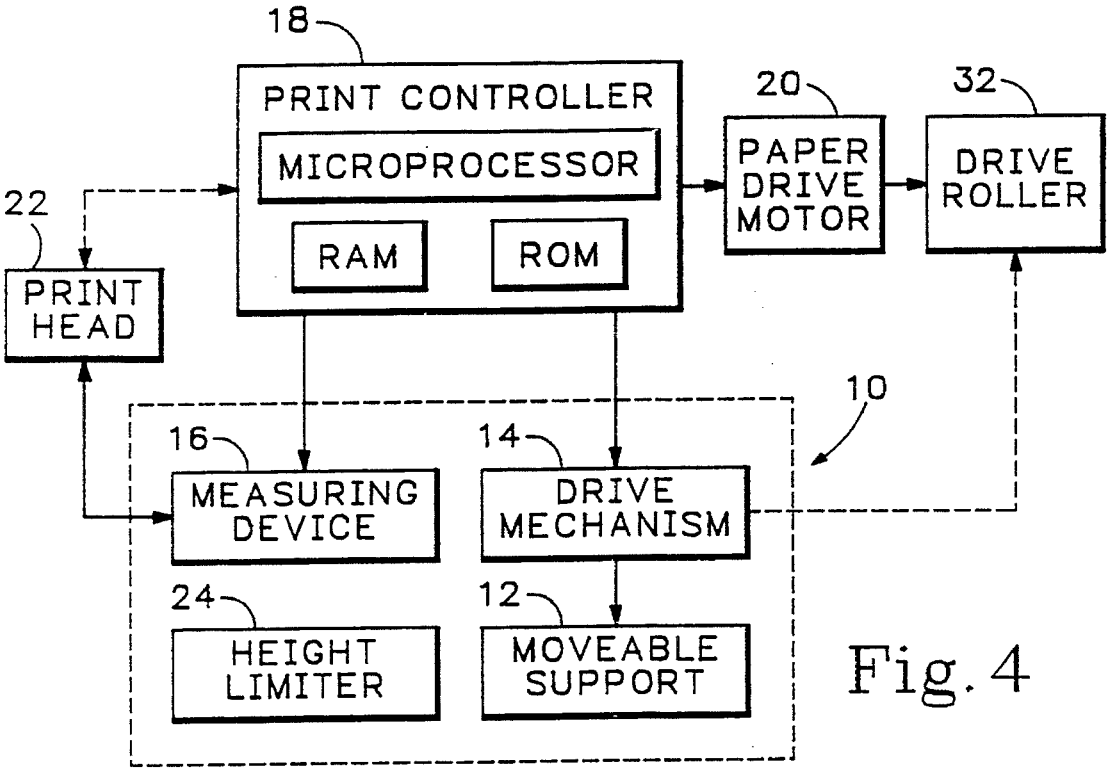
FIG. 4 is a schematic block diagram of the print material variable support mechanism.

The print material variable support mechanism 10, as shown within the dotted line of FIG. 4, includes a moveable support, or platen 12, a drive mechanism 14 and a measuring device 16. The mechanism can also be thought of as a platen operatively associated with a platen control device 14 which includes a measuring device 16. The drive mechanism and the measuring device are operatively associated with a print controller 18 which is in turn operatively associated with a paper drive motor 20 and a printhead 22. The measuring device can also be thought of as operatively coupled with the platen through the print controller. In the preferred embodiment, print material variable support mechanism 10 further includes a height or flexure limiter 24. Typically, measuring device 16 is an ink drop counter, as described in U.S. Ser. No. 07/951,255, filed Sep. 25, 1992 by Gast et al. for a DROP COUNT-BASED INK-JET PRINTER CONTROL METHOD AND APPARATUS, which is specifically incorporated herein by reference.

In the preferred embodiment, measuring device or ink density sensing mechanism 16 is an ink drop counter which counts the ink droplets fired or ejected from the printhead. Typically, the drop counter constitutes a part of the print controller and is preferably implemented in a custom large-scale integration (LSI) semiconductor device such as an application-specific integrated circuit (ASIC). Preferably, the drop counter is implemented in hardware, although it may also be implemented in firmware or software. The pen firing rate, or ink drop ejection rate, to which the drop counter is responsive can be as high as approximately 250 kHz, such that software or firmware implementation would require a dedicated, relatively high speed microprocessor. It will be appreciated that typically the measuring device, or printhead jet firing event counter, does not actually count ink drops, but instead counts instances of an ink-jet firing signal produced, for example, by a microprocessor within the print controller. Thus, in the preferred embodiment, the measuring device avoids the added complexity, cost and weight of a physical ink drop detector.

In another embodiment, the measuring device may be an optical scanner which visually reads ink density on a printed sheet. Such an optical scanner could include a light source and a detection mechanism. In another embodiment, the measuring device may include a print medium weight scale to determine ink density on the print material. Such an embodiment could include a pressure sensitive plate positioned on the supporting top surface of the platen. Such a weight scale would sense the weight of the printed sheet on the scale such that once a predetermined threshold of print material weight is reached, the print controller would effect movement of the platen to a retracted position. The measuring device may also be a hydrometer. Any means of detecting print ink density is contemplated, and is within the spirit and scope of the invention. In addition, this invention may be utilized in any printing process wherein print material buckles or bends such that the invention is not limited to wet ink printing.

Figure 1:
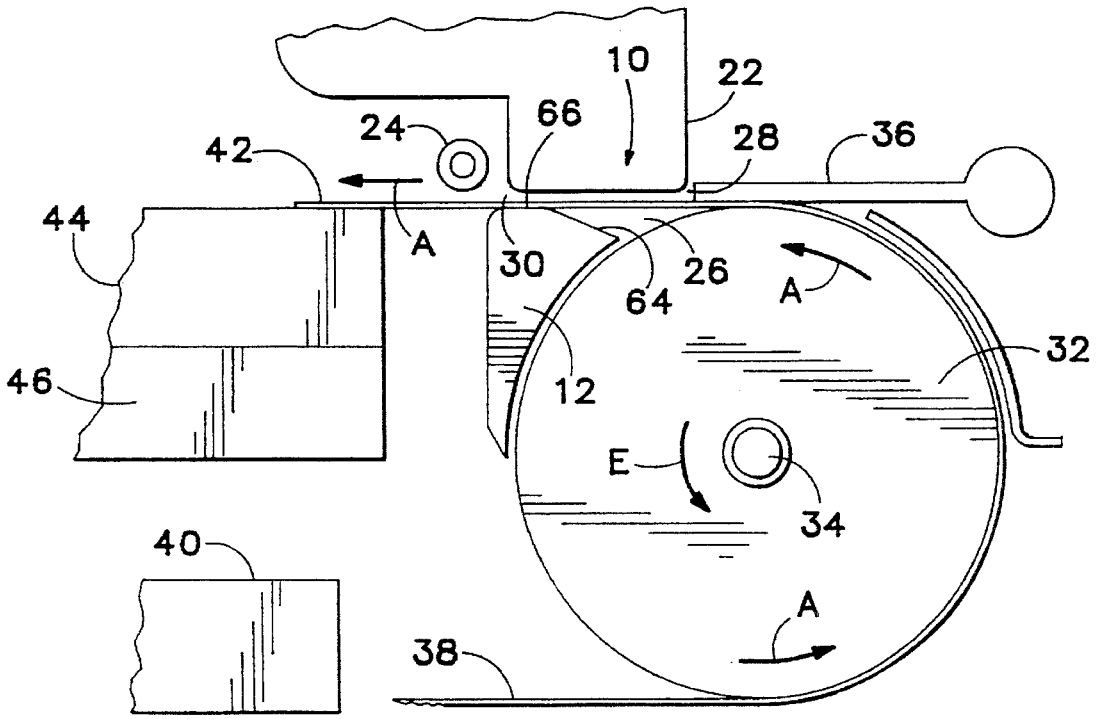
FIG. 1 shows the print material variable support mechanism in the upward position.
Figure 2:
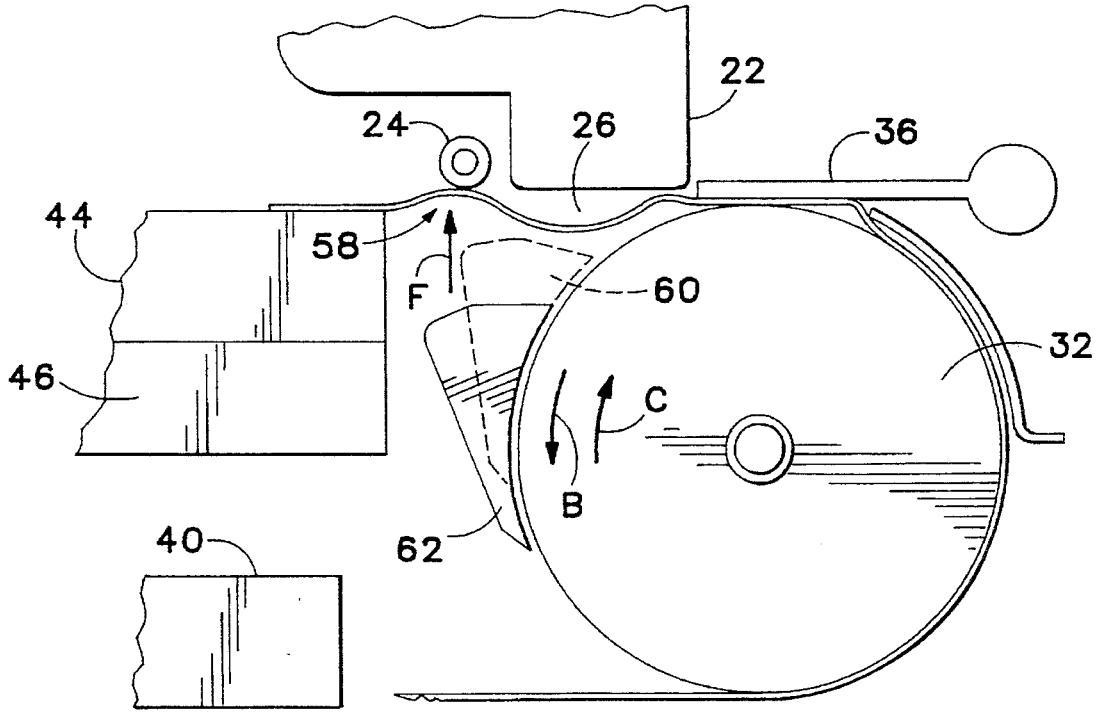
FIG. 2 shows the print material variable support mechanism of FIG. 1 in two different retracted positions.
Figure 3:
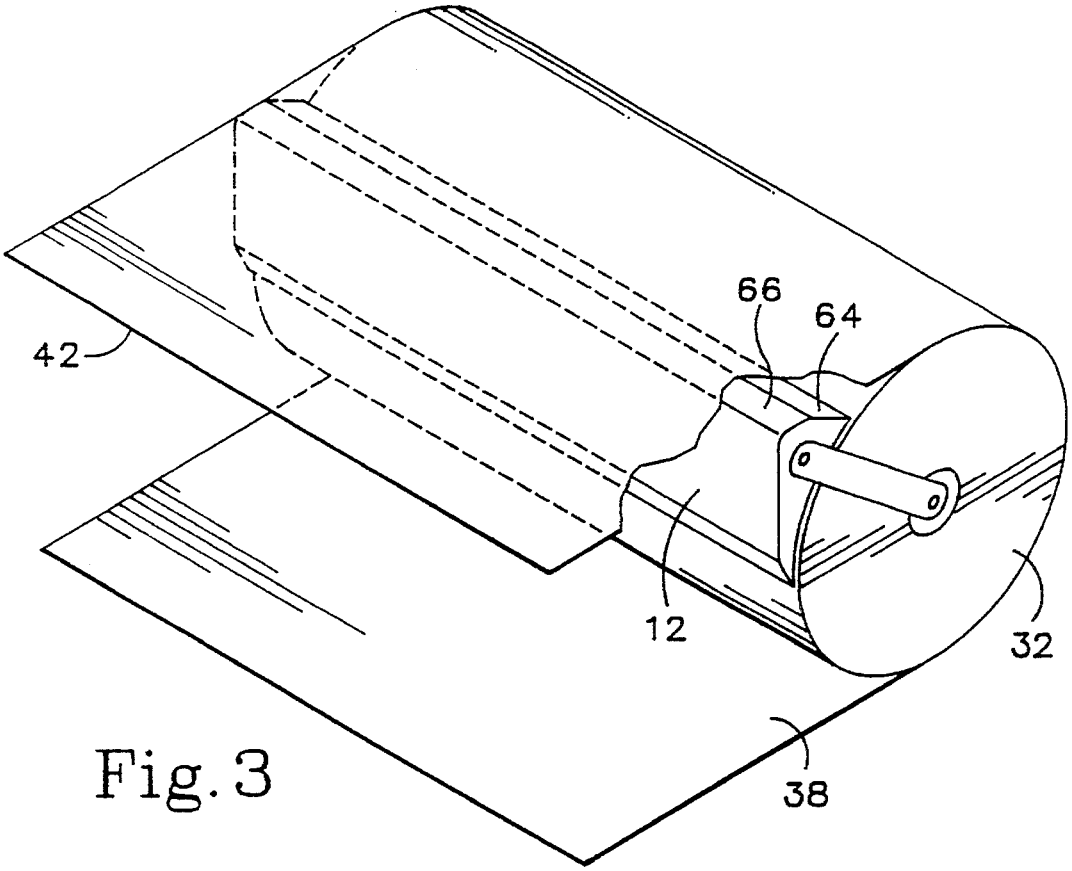
FIG. 3 shows another view of the print material variable support mechanism of FIG. 1 with a portion of the sheet removed.

As shown in FIG. 1, the moveable support 12, or platen, is typically positioned adjacent and below printhead 22. The platen and the printhead define a print zone 26 therebetween. The print zone includes an entrance area or region 28 and an exit area or region 30, the exit region being downstream from the entrance region as the print material travels in direction A. FIG. 2 shows a sheet of print material which is bent downwardly in print zone 26 with the platen in a retracted position. The bend shown in FIG. 2 is exaggerated for illustrative purposes and does not show three dimensioned bends, as shown in FIGS. 5A–5D, for the purpose of clarity.

Typically, the platen 12 is positioned adjacent a feed device, or drive roller, 32 having an axis of rotation 34. The roller rotates about the axis in direction E. In the preferred embodiment, the platen is pivotally rotatable about axis 34 of drive roller 32. A paper guide 36 is typically positioned above the drive roller and adjacent the printhead and the print zone entrance area or region.

In operation, the drive roller selects a sheet of print material 38 from an input tray 40. The drive roller then conveys the sheet around the drive roller in direction A such that the leading edge of the sheet 42 is conveyed between the drive roller and the paper guide. Thereafter, the leading edge is conveyed through the print zone in direction A, such that the sheet is positioned below the printhead and above the platen. As the leading edge is conveyed through the print zone, the printhead begins printing upon the portion of the sheet positioned in the print zone. Printing on the sheet is continued as the leading edge is conveyed through the print zone exit area, or region, and onto the wings 44 of an output tray 46.

A height or buckling limiter, 24, is positioned generally adjacent the print zone exit area, or region and is positioned above a sheet of print material such that the height limiter prevents the sheet from buckling or curving upwardly past the height limiter. Typically, height limiter 24 comprises one or more star wheels which prevent upward curling or buckling of the sheet without smearing freshly printed ink on the print material. Contact with the star wheel is minimized, and typically nonexistent, for unprinted sheets and low ink density printing because the sheet does not tend to curve in these situations, as shown by the unprinted sheet 38 in FIG. 5A.

Figure 5A:
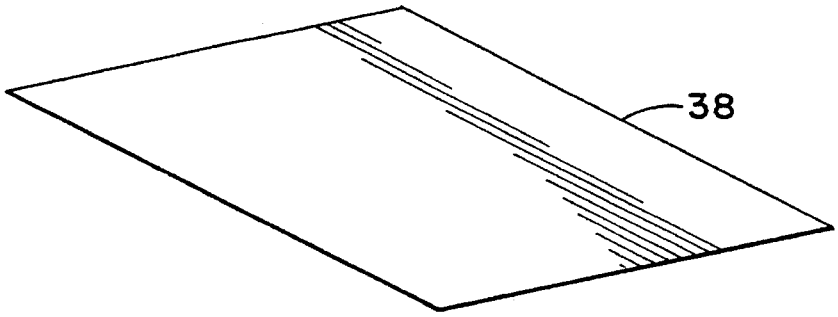
FIGS. 5A through 5D show sheets of print material and various types of sheet bending or curling.
Figure 5B:
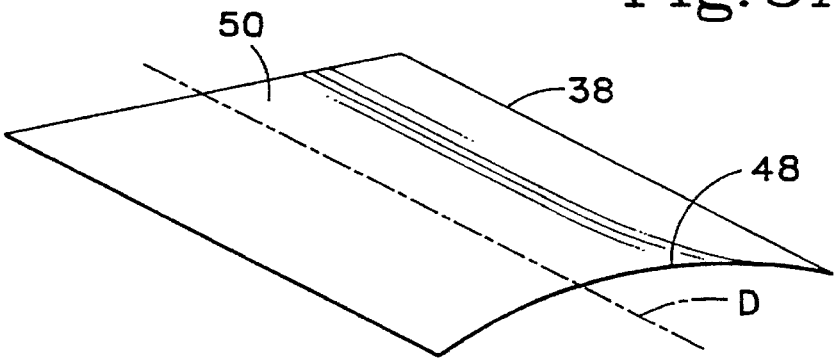
Figure 5C:
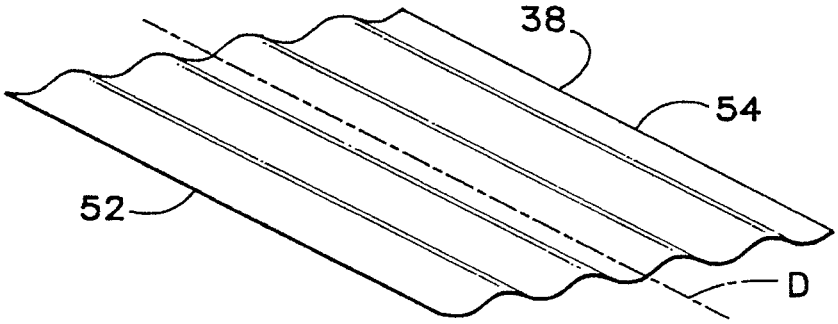

In high ink density situations, bending or curving of the sheet can occur. This bending can develop in several forms. The first of these is shown in FIG. 5B and is generally in the shape of a tent. The bending appears somewhat like a cone split in half, such that at the leading edge, or first edge 48, of the printed paper curves like an inverted "U" and tapers to virtually no bending at the point where the paper is held rigidly by the print roller and the paper guide, at a back region 50. A second type of bending is shown in FIG. 5C. This bending is generally wave shaped, with waves extending in a bellows or zig-zag type shape from one side 52 to a second side 54 of the sheet or page 38. This bending is also referred to as high-density cockle. In another case, shown in FIG. 5D, a sheet contains tent type bending and high-density type bending such that the leading edge 56 contains wave type bending and inverted "U" type bending. The bends generally form parallel to or symmetrically about elongate axis D of the sheet, axis D being parallel to the sheet direction of travel A.

The bends created within the sheet material by the ink, typically wet ink, tend to stiffen the sheet. If a relatively low density of ink is printed on the paper, the paper does not form rigid bends and tends to droop downwardly if not supported on its underside 58. Thus, a sheet bent due to low density ink printing is slightly stiffer than an unprinted sheet and can bend upwardly a sufficient distance to contact the printhead, causing smearing. A sheet bent due to high density ink printing typically is even stiffer than a sheet of low density ink printing and can bend upwardly even more than a sheet with low ink density printing. Thus, in the preferred embodiment, the platen is moveable to numerous retracted positions generally adjacent sheet underside 58 to give the sheet varying degrees of support ranging from none to full. During periods of medium ink print density, platen 12 may be retracted to an intermediate position 60, shown in phantom in FIG. 2. In this intermediate position, the platen supports the print material if the sheet buckles away from the printhead enough to contact the platen. During periods of high ink density printing, the platen is moved to a fully retracted position 62 such that the platen does not contact the under side of the print sheet.

Typically the sheet is conveyed through the print zone with the upper and lower surfaces being generally horizontally positioned. In this arrangement the platen upper surface and the printhead are also horizontally positioned below and above the sheet, respectively. In another embodiment, the sheet can be vertically positioned such that the platen top surface and the printhead are also vertically positioned. In this arrangement the platen is positioned to one side of the sheet and the printhead is located on the other side of the sheet.

In the invented mechanism, as the sheet's leading edge 42 is conveyed into the print zone entrance area, platen 12 is in the full-support, or first position, shown in FIG. 1, such that the platen is positioned closely adjacent and below the printhead. As the leading edge 42 is conveyed through the print zone, it contacts sloping surface 64 of platen 12, which prevents the paper from continuing around the drive roller in direction E. As the leading edge of the sheet is further conveyed through the print zone, the leading edge contacts support surface 66 of platen 12. Support surface 66 is generally aligned with the wings 44 of an output tray 46 such that, while the leading edge is conveyed past the platen, the support surface supports the print material such that it is conveyed onto the wings 44 of the output tray 46.

Figure 5D:
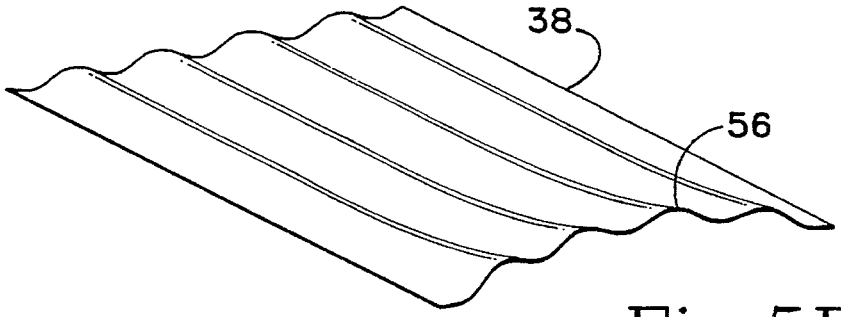

A print controller 18 is operatively associated with the paper drive motor 20 which controls the drive roller 32. The print controller is also operatively associated with the printhead 22. As the drive roller conveys a sheet of print material under the printhead, the print controller signals the printhead to begin printing. During the printing process, the printhead, typically an ink-jet, fires or ejects ink droplets onto the sheet of print material. As ink is fired onto the sheet material, the ink wets the fibers of the print material, which may lead to sheet buckling or waving, as shown in FIGS. 5B through 5D.

In operation, a sheet 38 is conveyed around the drive roller 32, such that the leading edge 42 is conveyed through the print zone 26. The leading edge contacts sloping surface 64, and is thereafter conveyed onto support surface 66. The printhead 22 begins printing on the sheet when a region of the sheet is positioned in the print zone 26. The platen 12 supports the sheet until leading edge 42 is supported by the wings 44 of the output tray 46. If high ink density printing begins before the leading edge contacts the wings, in the preferred embodiment, the platen will remain in the first position (see FIG. 1) supporting the sheet until the leading edge is supported by the wings. In such a case, the sheet will tend to buckle upwardly during this initial phase of printing. However, height or flexure limiter 24 will reduce the risk of contact of the sheet with the printhead 22 by preventing the sheet from buckling upwardly past the height limiter in direction F. Once the leading edge is positioned on the wings, the platen is lowered (see FIG. 2) so that the sheet may buckle downwardly throughout the rest of the printing process.

Movement of the platen is effected by drive mechanism 14 which is operatively associated with the print controller 18. In the preferred embodiment, the print controller is operatively associated with a measuring device 16 which measures the ink density of printing by the printhead 22. In response to a high ink density condition detected by the measuring device, the print controller effects movement of the platen by drive mechanism 14 such that the platen moves in direction B, shown in FIG. 2. In another way of describing the invention, a platen control device includes an ink density sensing mechanism 16 which is operatively associated with platen 12 to effect movement of the platen away from the print medium when the sensing mechanism senses relatively high ink density during printing.

In the preferred embodiment, the drive mechanism is a clutch assembly such that movement of the platen is effected by the platen engaging the drive roller 32. When engaged with the drive roller, the platen moves in direction B, such that the platen moves in unison with the drive roller. After the platen is positioned in the desired retracted location, the platen is disengaged from the drive roller, such that the drive roller continues to move in direction E without effecting further pivotal movement of the platen. The platen is then moved in direction C to the first or original position by a spring mechanism such that the platen is positioned to support a new sheet of print material. In this clutch mechanism/spring arrangement, a separate drive mechanism is not necessary for the platen, but instead, the platen uses the drive mechanism of the drive roller and the spring to effect movement of the platen. This embodiment reduces the manufacturing cost and the size of the printer because an additional drive mechanism is not needed.

INDUSTRIAL APPLICABILITY

The invented variable support mechanism for reducing buckling of print material toward a printhead during printing may be incorporated into existing printer designs without appreciably increasing the cost of manufacturing or the complexity of the printer. Thus, the variable support mechanism increases print quality by insuring adequate pen-to-sheet material spacing such that the sheet does not contact the printhead and therefore does not smear ink during printing.

While the present invention has been shown and described with reference to the foregoing operational principles and preferred embodiment, it will be apparent to those skilled in the art that other changes in form and detail may be made therein without departing from the spirit and scope of the invention as defined in the appended claims.

We claim:

1. A wet ink printer mechanism to reduce buckling of print medium toward a printhead during printing, the printer mechanism comprising:

a moveable platen positioned adjacent a print medium during printing, the platen supporting the print medium during relatively low ink density printing;

a drive mechanism operatively connected to the platen such that the drive mechanism selectively moves the platen away from the print medium during relatively high ink density printing, thereby allowing the print medium to buckle away from a printhead during relatively high ink density printing; and a platen control device including an ink density sensing mechanism, the platen control device operatively connected to the drive mechanism to effect movement of the platen away from the print medium when the ink density sensing mechanism senses relatively high ink density during printing.

2. The printer mechanism of claim 1 which further comprises a buckling limiter positioned adjacent the print medium and downstream from the printhead, the buckling limiter preventing the print medium from buckling past the buckling limiter to prevent the print medium from contacting the printhead.

3. In a wet ink printer mechanism, the improvement comprising:

a measuring device for measuring ink density on a print medium during printing;

a drive mechanism operatively connected to the measuring device; and a selectively positionable platen below the print medium and operatively connected to the drive mechanism, the platen being in a first position when the measuring device senses relatively low ink density on the print medium such that the platen supports the print medium during printing, the drive mechanism moving the platen to a second position when the measuring device senses relative high ink density on the print medium such that the platen allows the print medium to bend downwardly away from a printhead.

4. The improvement of claim 3 which further comprises a height limiter to prevent the print medium from bending upwardly above the height limiter thereby preventing the print medium from contacting a printhead.

5. The improvement of claim 3, wherein the drive mechanism includes a drive roller for conveying the print medium under the printhead and also for selectively moving the platen away from the print medium.

6. A print medium support system to reduce upward curving of a print medium toward a printhead during wet ink printing, the system comprising:

a printhead for printing on a print medium;

a moveable platen positioned below the printhead, the printhead and the platen defining a print zone therebetween, the print zone having an entrance region and an exit region;

a drive mechanism positioned upstream of the print zone entrance region and selectively coupled with the platen, the drive mechanism conveying the print medium through the print zone during printing; and an ink density measuring device operatively coupled with the platen, the measuring device being capable of determining ink density on the print medium such that the platen is nominally in an engaged position supporting the underside of the print medium when the measuring device senses low ink density on the print medium, with the drive mechanism moving the platen away from the print medium when the measuring device senses high ink density on the print medium.

7. The print medium support system of claim 6 which further comprises a height limiter to prevent the print medium from bending upwardly above the height limiter thereby preventing the print medium from contacting a printhead.

8. The print medium support system of claim 7 wherein the density measuring device includes a printhead jet firing event counter.

9. The print medium support system of claim 7 wherein the density measuring device includes an optical scanner.

* * * * *